US008844752B2

(12) United States Patent
Sirota et al.

(10) Patent No.: US 8,844,752 B2
(45) Date of Patent: Sep. 30, 2014

(54) REVERSIBLE FOOD PLATES HAVING A SLOPE, METHODS OF USE, AND SLOPE ADAPTER FOR FOOD PLATE AND METHOD OF MAKING SAME

(71) Applicants: Seth Sirota, St. James, NY (US); Michele Sirota, St. James, NY (US)

(72) Inventors: Seth Sirota, St. James, NY (US); Michele Sirota, St. James, NY (US)

( * ) Notice: Subject to any disclaimer, the term of this patent is extended or adjusted under 35 U.S.C. 154(b) by 0 days.

(21) Appl. No.: 13/918,982

(22) Filed: Jun. 16, 2013

(65) Prior Publication Data

US 2013/0313265 A1 Nov. 28, 2013

Related U.S. Application Data

(62) Division of application No. 12/701,510, filed on Feb. 5, 2010, now Pat. No. 8,490,823.

(51) Int. Cl.

| | |
|---|---|
| ***B65D 1/24*** | (2006.01) |
| ***A47G 19/08*** | (2006.01) |
| ***A47G 19/02*** | (2006.01) |

(52) U.S. Cl.

CPC ..... *A47G 19/08* (2013.01); *A47G 19/02* (2013.01)

USPC ..... 220/503; 220/504; 220/554; 220/555; 220/556; 220/574; 220/274.1; 220/575; 220/628; 220/631; 220/632; 220/636

(58) Field of Classification Search

USPC ..... 220/574, 574.1, 575, 628, 632, 636, 220/503, 504, 557, 555, 556, 631; 264/239

See application file for complete search history.

(56) References Cited

U.S. PATENT DOCUMENTS

| | | | |
|---|---|---|---|
| 766,427 | A | 8/1904 | Crowell |
| 876,808 | A | 1/1908 | Kinert |
| 1,272,996 | A | 7/1918 | Poschadel |
| 52,278 | A | 8/1918 | Kraus |
| 1,379,519 | A | 5/1921 | Bjornsen |
| 1,488,462 | A | 4/1924 | Edmund |
| 1,520,402 | A | 12/1924 | Clemans |
| 2,170,311 | A | 8/1939 | Smith |
| 2,207,417 | A | 7/1940 | Smith |
| D162,013 | S | 2/1951 | Day |
| 2,561,594 | A | 7/1951 | Pokras |
| D168,283 | S | 12/1952 | Adams |
| 2,655,016 | A | 10/1953 | Hudson |

(Continued)

*Primary Examiner* — Fenn Mathew
*Assistant Examiner* — Elizabeth Volz
(74) *Attorney, Agent, or Firm* — Carol Larcher; Larcher & Chao Law Group

(57) ABSTRACT

A food plate comprising a first surface, a second surface, and an edge, wherein at least the first surface or each of the first surface and the second surface has a slope, which optionally comprises at least one depression at the bottom of the slope and adjacent to the edge, wherein (i) at least each portion of the edge that is adjacent to the bottom of the slope forms a rim or (ii) substantially all or all of the edge forms a rim and at least each portion of the rim that is adjacent to the bottom of the slope is pronounced or more pronounced than a portion of the rim that is not adjacent to the bottom of the slope; an adapter for a conventional food plate comprising a graduated, optionally flexible, rim, which, upon attachment to the food plate, causes the food-bearing side of the food plate to have a slope; a method of making a food plate; and a method of making an adapter for a conventional food plate.

13 Claims, 7 Drawing Sheets

(56) References Cited

U.S. PATENT DOCUMENTS

| | | | | |
|---|---|---|---|---|
| 2,672,697 | A | 3/1954 | La Tour | |
| 2,843,287 | A | 7/1958 | Finley | |
| 3,014,616 | A * | 12/1961 | Kavanaugh et al. | 206/509 |
| 3,611,998 | A | 10/1971 | Loscalzo | |
| D238,739 | S | 2/1976 | Thomas | |
| D244,338 | S | 5/1977 | Yauger | |
| 4,351,444 | A | 9/1982 | Majewski | |
| D283,096 | S | 3/1986 | Uhrik | |
| D305,846 | S | 2/1990 | Griffith | |
| 4,986,434 | A | 1/1991 | Prestyly, Jr. | |
| 5,172,826 | A | 12/1992 | Celaya | |
| 5,341,953 | A | 8/1994 | Forester | |
| 5,390,816 | A | 2/1995 | Boyd | |
| D367,587 | S | 3/1996 | Perlmutter et al. | |
| 5,542,565 | A | 8/1996 | Hidalgo-Lopez | |
| 5,638,981 | A | 6/1997 | Crane et al. | |
| 5,676,275 | A | 10/1997 | Khattar | |
| D390,419 | S | 2/1998 | Perlmutter et al. | |
| D396,778 | S | 8/1998 | Asphar | |
| D433,283 | S | 11/2000 | Thomas | |
| D434,276 | S | 11/2000 | Obra | |
| D473,758 | S | 4/2003 | Wilson | |
| D481,594 | S | 11/2003 | Roehrig | |
| 7,637,388 | B2 | 12/2009 | Schantz et al. | |
| 2007/0039966 | A1 | 2/2007 | Schantz et al. | |
| 2010/0096391 | A1 | 4/2010 | Schantz et al. | |

* cited by examiner

REVERSIBLE FOOD PLATES HAVING A SLOPE, METHODS OF USE, AND SLOPE ADAPTER FOR FOOD PLATE AND METHOD OF MAKING SAME

CROSS REFERENCE TO RELATED APPLICATIONS

This application is a Divisional of copending U.S. patent application Ser. No. 12/701,510, filed Feb. 5, 2010, the content of which is herein incorporated by reference in its entirety.

TECHNICAL FIELD

The present disclosure relates to a food plate, an adapter for a food plate, and methods of making same.

BACKGROUND

A food plate provides a food-bearing surface for serving and eating food. It is common for meat, vegetables, and either potatoes or rice to be placed on the same plate. Depending on how the meat, vegetables, and potatoes/rice are prepared, it is not unusual for liquid, such as water, butter or sauce, from the vegetables to come in contact with the other food on the plate. Likewise, toppings on potatoes/rice, such as gravy, sauce, butter and/or sour cream, can contact the other food on the plate. Natural juices and fat/grease from meat, as well as sauce or gravy, as the case may be, also can contact other food on the plate. While some individuals are not bothered by this and, perhaps, even prefer it, other individuals do not like one food item to come in contact with another item, whether it is due to the impact of such contact on flavor, an underlying obsessive-compulsive disorder, special needs, a dietary restriction, or other reason. Divided plates have been proposed to keep food items on a plate separate from each other. However, divided plates are disadvantageous in that it can be difficult for certain people to eat off a divided plate. Furthermore, divided plates do not eliminate the problem of vegetables sitting in liquid, such as water, and meat sitting in fat/grease. Scooper plates and plate guards have been proposed to aid (i) individuals with physical disabilities, such as those with hand tremors (e.g., individuals with Parkinson's disease), uncontrolled movement of the hands, restricted movement of the hands (e.g., individuals with arthritis or partial paralysis or recovering from stroke), injuries, and birth defects, (ii) children, who are learning to eat, and (iii) individuals with various types of mental/learning disabilities, to eat off of plates by providing a plate with a graduated side wall that is shallow on one side and deep on the other (see, e.g., Freedom Dinnerware Scooper Plate, which is available from www.arthritissupplies.com) or a truncated side wall (see, e.g., plate guards available from Arthritis Supplies's website and My Plate-Mate™, which is available from www-.myplate-mate.com). Scooper plates, which come in flat and divided versions, and plate guards, however, still do not address the problem of vegetables sitting in liquid, such as water, and meat sitting in fat/grease.

In addition to the above, it is also common for a food item to be placed on the same plate with a topping, such as a sauce or a syrup, or condiment, such as ketchup, with which it is intended to be eaten. Unfortunately, many such food items become soggy when left in contact with such a topping, even for the length of time it takes to eat the food item. Sometimes, the food item becomes unpalatable as a result, either due to texture and/or flavor (e.g., becoming too sweet). Keeping the liquid topping in a separate container (e.g., a small bowl or a condiment cup) has been proposed to address this problem. However, when the separate container is kept on the plate, it can interfere with eating off the plate, and, when the separate container is kept beside the plate, drips between the container and the plate often result as do spills, thereby creating a mess to clean up. Divided plates also have been proposed to address this problem. However, as noted above, it can be difficult for certain people to eat off a divided plate.

In view of the above, there remains a need for a food plate that (i) is easy for a person, including a person with a disability, to eat off, (ii) minimizes, and preferably eliminates, vegetables sitting in liquid and meat sitting in fat/grease, and (iii) keeps a food item and a liquid topping separate in a way that does not interfere with eating off the food plate and minimizes, and preferably eliminates, messiness. It is an object of the present disclosure to provide such a food plate. This and other objects and advantages, as well as inventive features, will become apparent from the detailed description provided herein.

SUMMARY

A food plate is provided. The food plate comprises a first surface having a slope, a second surface, and an edge.

In one embodiment of the food plate, the first surface, which has a slope, optionally comprises at least one depression, and preferably comprises one depression, at the bottom of the slope and adjacent to the edge. Either (i) at least each portion of the edge that is adjacent to the bottom of the slope forms a first rim or (ii) substantially all or all of the edge forms a first rim and at least each portion of the first rim that is adjacent to the bottom of the slope is pronounced or more pronounced than a portion of the first rim that is not adjacent to the bottom of the slope. The second surface is substantially flat or flat and optionally slip-resistant. The food plate can be removably attached to a flat or substantially flat surface. The food plate can be reversible such that food can be placed on the first surface or the second surface and, when food is to be placed on the second surface, the first rim of the first surface can be stably placed on a flat or substantially flat surface with the outer edge or edges of the first rim substantially parallel or parallel to the flat or substantially flat surface. The food plate can be stackable. The food plate can further comprise a removable lid. Optionally, one or more eating utensils can be removably attached to the removable lid.

In another embodiment, the second surface of the above-described food plate can have a slope. The slope of the second surface optionally comprises at least one depression, and preferably comprises one depression, at the bottom of the slope and adjacent to the edge. When the second surface has a slope, preferably the bottom of the slope of the first surface is at the opposite end of the plate from the bottom of the slope of the second surface. Either (i) at least each portion of the edge that is adjacent to the bottom of the slope forms a second rim or (ii) substantially all or all of the edge forms a second rim and at least each portion of the second rim that is adjacent to the bottom of the slope is pronounced or more pronounced than a portion of the second rim that is not adjacent to the bottom of the slope. When the first surface and the second surface have slopes, either (i) the first rim of the first surface can be stably placed on a flat or substantially flat surface with the outer edge or edges of the first rim substantially parallel or parallel to the flat or substantially flat surface or (ii) the second rim of the second surface can be stably placed on a flat or substantially flat surface with the outer edge or edges of the second rim substantially parallel or parallel to the flat or substantially flat surface. The food plate can be stackable. The food plate can further comprise at least one removable lid. Optionally, one or more eating utensils can be removably attached to the removable lid.

Also provided is an adapter for a conventional food plate. The adapter comprises a graduated, optionally flexible, rim. Upon attachment to the food plate, the graduated rim causes the food-bearing side of the food plate to have a slope. The graduated rim optionally comprises, and preferably does comprise, an interior groove or interior ledge into/onto which the edge of the conventional food plate can be placed. The adapter can further comprise an adjoining depression, which, upon attachment of the adapter to the food plate, results in the depression being positioned at the bottom of the slope. The adjoining depression is optionally removable from the graduated rim or the conventional food plate at the bottom of the slope. The graduated rim can comprise at least a first part and a second part (such as a first part, a second part, a third part, and a fourth part). When the graduated rim comprises at least a first part and a second part, the adapter can further comprise an adjuster. The adjuster adjusts the distance between at least the first part and the second part to position the adapter onto the plate. The adapter can further comprise a removable lid. Optionally, one or more eating utensils can be removably attached to the removable lid.

In view of the above, provided is a method of making a food plate. The method comprises forming a food plate comprising a first surface having a slope, a second surface, and an edge. The slope optionally comprises at least one depression, and preferably comprises one depression, at the bottom of the slope and adjacent to the edge. Either (i) at least each portion of the edge that is adjacent to the bottom of the slope is formed into a first rim or (ii) substantially all or all of the edge is formed into a first rim and at least each portion of the first rim that is adjacent to the bottom of the slope is pronounced or more pronounced than a portion of the first rim that is not adjacent to the bottom of the slope. The second surface can have a slope. The slope optionally comprises at least one depression, and preferably comprises one depression, at the bottom of the slope and adjacent to the edge. Either (i) at least each portion of the edge that is adjacent to the bottom of the slope is formed into a second rim or (ii) substantially all or all of the edge is formed into a second rim and at least each portion of the second rim that is adjacent to the bottom of the slope is pronounced or more pronounced than a portion of the second rim that is not adjacent to the bottom of the slope.

Also in view of the above, a method of making an adapter for a conventional food plate is provided. The method comprises forming a graduated, optionally flexible, rim, which optionally comprises at least a first part and a second part and which, upon attachment to the conventional food plate, causes the food-bearing side of the food plate to have a slope, and, optionally, introducing an interior groove or an interior ledge into the graduated rim into/onto which the edge of the conventional food plate can be placed. The adapter can further comprise an adjoining depression, which, upon attachment of the adapter to the conventional food plate, results in the depression being positioned at the bottom of the slope. The adjoining depression can be part of the graduated rim or removably attached to the graduated rim or the conventional food plate at the bottom of the slope. The method can further comprise introducing an adjuster between at least the first part and the second part.

DETAILED DESCRIPTION

A food plate comprising a first surface having a slope, a second surface, and an edge is provided. At least the first surface has a slope. Desirably, the degree of the slope is sufficient to allow a liquid to move down the slope. Preferably, the degree of the slope is sufficient to allow a viscous liquid, such as syrup, to move down the slope. The degree of the slope should not be so great as to make eating off the food plate difficult. Preferably, the slope is less than about 15°, such as about 2.5°, about 5°, about 7.5°, about 10°, or about 12.5°. The slope of the first surface optionally comprises at least one depression, and preferably comprises one depression, at the bottom of the slope and adjacent to the edge. For ease of reference, the term "adjacent" is used herein to encompass adjacent, adjoining, and contiguous. The overall dimensions of the depression are not critical. Preferably, the depression is large enough to contain at least a single serving of a liquid, such as syrup, or a condiment, such as ketchup. At least each portion of the edge that is adjacent to the bottom of the slope (and, when present, the depression) forms a rim (a "first rim" on the first surface of the food plate and a "second rim" on the second surface of the food plate) or substantially all or all of the edge forms a rim (first rim or second rim) and at least each portion of the rim (first rim or second rim) that is adjacent to the bottom of the slope (and, when present, the depression) is pronounced or more pronounced than a portion of the rim (first rim or second rim) that is not adjacent to the bottom of the slope. For ease of reference, the term "pronounced" is used herein to encompass taller (see, e.g., the graduated rim (54) on the left as compared to the graduated rim (54) on the right in FIG. 6), as well as wider, thicker, curved, or more curved, and the like. Preferably, the pronounced portion is taller.

Figure 1:
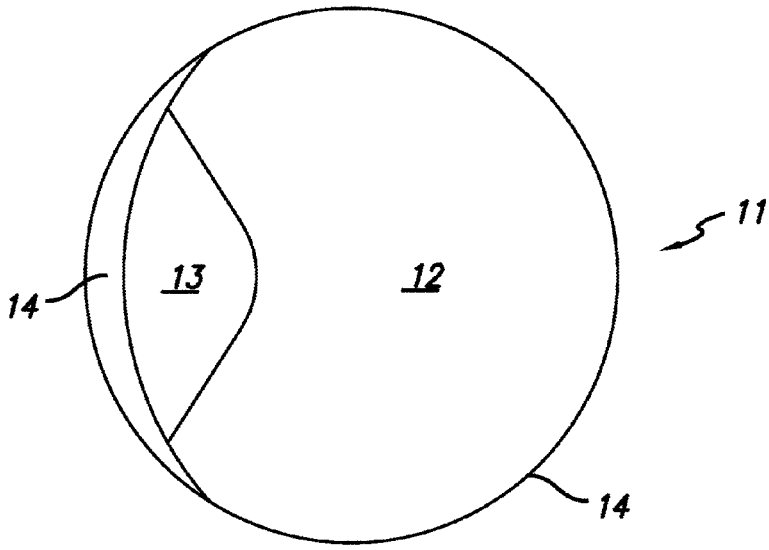
FIG. 1 is a top view of a food plate (11) comprising a first surface (12) having a slope comprising a depression (13). The edge of the food plate forms a first rim (14), which is shown optionally curved adjacent to the bottom of the slope.

FIG. 1 is a top view of a food plate (11) comprising a first surface (12) having a slope comprising a depression (13). The edge of the food plate forms a first rim (14), which is shown optionally curved adjacent to the bottom of the slope.

The second surface of the food plate can be substantially flat or flat. When the second surface of the food plate is substantially flat or flat, optionally the second surface is slip-resistant. The second surface, itself, can be textured, which in and of itself renders the surface slip-resistant. Alternatively, the second surface can comprise a suction pad or the like, which can be attached to a flat surface, such as a table, a tray, or a placemat. Alternatively, a tray or a placement can comprise clips or the like that can hold the food plate in place. In the absence of a suction pad or the like, the second surface of the food plate can function as a second food-bearing surface. In other words, the food plate can be reversed, such that the first surface (12) having a slope comprising a depression (13) can be used before or after the second surface, which is substantially flat or flat.

Figure 3:
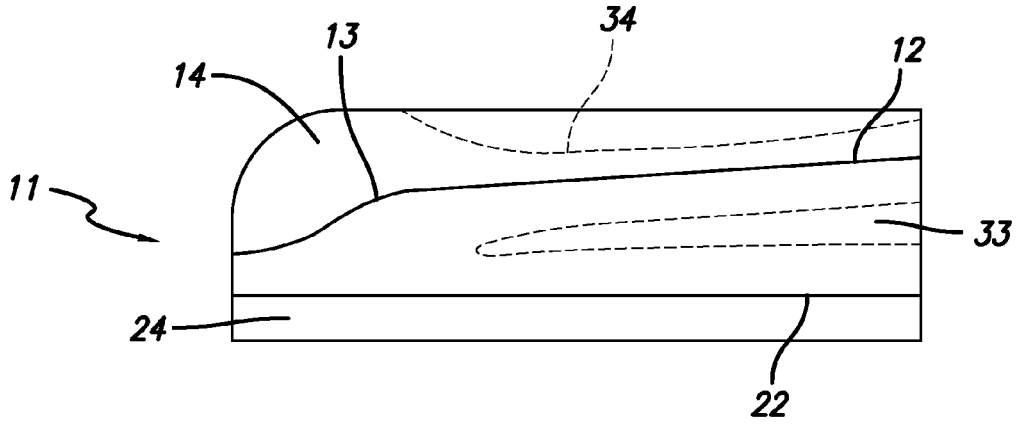
FIG. 3 is a cross-sectional view of a food plate (11) comprising a first surface (12) having a slope comprising a depression (13) and a second surface (22), which is flat. The first rim (14) is pronounced or more pronounced, i.e., taller, adjacent to the bottom of the slope, and is shown optionally curved adjacent to the bottom of the slope. The second rim (24) is shown uniform but need not be. The dotted area (33) represents a hollow area that is optionally present within the plate. The dotted line (34) shows an alternate edge of the first rim (14).

FIG. 3 is a cross-sectional view of a food plate (11) comprising a first surface (12) having a slope comprising a depression (13) and a second surface (22), which is flat. The first rim (14) is pronounced or more pronounced, i.e., taller, adjacent to the bottom of the slope, and is shown optionally curved adjacent to the bottom of the slope. The second rim (24) is shown uniform but need not be. The dotted area (33) represents a hollow area that is optionally present within the plate. The dotted line (34) shows an alternate edge of the first rim (14). Food can be placed on the first surface or the second surface. When food is to be placed on the second surface, the first rim of the first surface can be stably placed on a flat or substantially flat surface with the outer edge or edges of the first rim substantially parallel or parallel to the flat or substantially flat surface.

Another food plate comprising a first surface having a slope, a second surface having a slope, and an edge is also provided. Each of the first surface and the second surface optionally comprises at least one depression, and preferably comprises one depression, at the bottom of the slope and adjacent to the edge of the plate. Preferably, the depression on the first surface is on the opposite side of the plate from the depression on the second surface. At least each portion of the edge that is adjacent to the bottom of the slope (and, when present, the depression) on the first surface forms a first rim or substantially all or all of the edge forms a first rim and at least each portion of the first rim that is adjacent to the bottom of the slope (and, when present, the depression) is pronounced or more pronounced than a portion of the first rim that is not adjacent to the bottom of the slope. At least each portion of the edge that is adjacent to the bottom of the slope (and, when present, the depression) on the second surface forms a second rim or substantially all or all of the edge forms a second rim and at least each portion of the second rim that is adjacent to the bottom of the slope (and, when present, the depression) is pronounced or more pronounced than a portion of the second rim that is not adjacent to the bottom of the slope. The bottom edge (i.e., the edge that is not the outer edge or edges) of the first rim and the bottom edge (i.e., the edge that is not the outer edge or edges) of the second rim can be separated from or adjoined to each other. Either (i) the first rim of the first surface can be stably placed on a flat or substantially flat surface with the outer edge or edges of the first rim substantially parallel or parallel to the flat or substantially flat surface or (ii) the second rim of the second surface can be stably placed on a flat or substantially flat surface with the outer edge or edges of the second rim substantially parallel or parallel to the flat or substantially flat surface.

Figure 2:
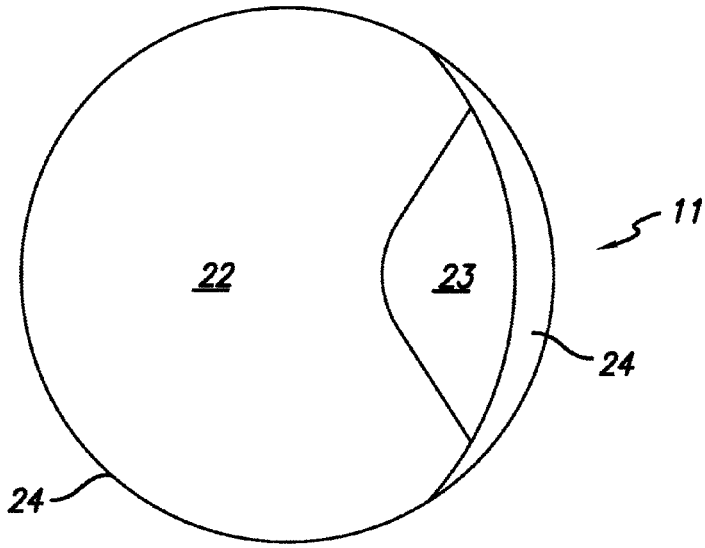
FIG. 2 is a bottom view of a food plate (11) comprising a second surface (22) having a slope comprising a depression (23). The edge of the food plate forms a second rim (24), which is shown optionally curved adjacent to the bottom of the slope.
Figure 4:
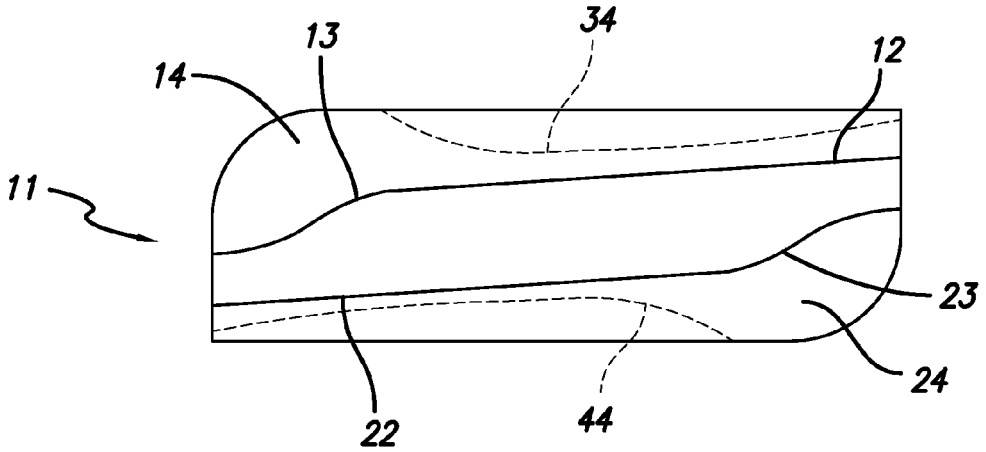
FIG. 4 is a cross-sectional view of a food plate (11) comprising a first surface (12) having a slope comprising a depression (13) and a second surface (22) having a slope comprising a depression (23). The depression (13) on the first surface (12) is on the opposite side of the plate from the depression (23) on the second surface (22). The dotted line (34) shows an alternate edge of the first rim (14), whereas the dotted line (44) shows an alternate edge of the second rim (24).

FIG. 4 a cross-sectional view of a food plate (11) comprising a first surface (12) having a slope comprising a depression (13) (as shown in FIG. 1) and a second surface (22) having a slope comprising a depression (23) (as shown in FIG. 2, which is a bottom view of a food plate (11) comprising (i) a second surface (22) having a slope comprising a depression (23) and (ii) a second rim (24), which is shown optionally curved adjacent to the bottom of the slope). The depression (13) on the first surface is on the opposite side of the plate from the depression (23) on the second surface. In this cross-sectional view of a food plate, the first rim (14) and the second rim (24) are shown optionally curved in the region of the bottom of the slope. The dotted line (34) shows an alternate edge of the first rim, whereas the dotted line (44) shows an alternate edge of the second rim (24). The first rim and the second rim can comprise alternate edges, which can be the same or different.

Food can be placed on the first surface or the second surface. When food is to be placed on the second surface, the first rim of the first surface can be stably placed on a flat or substantially flat surface with the outer edge or edges of the first rim substantially parallel or parallel to the flat or substantially flat surface.

Figure 9:
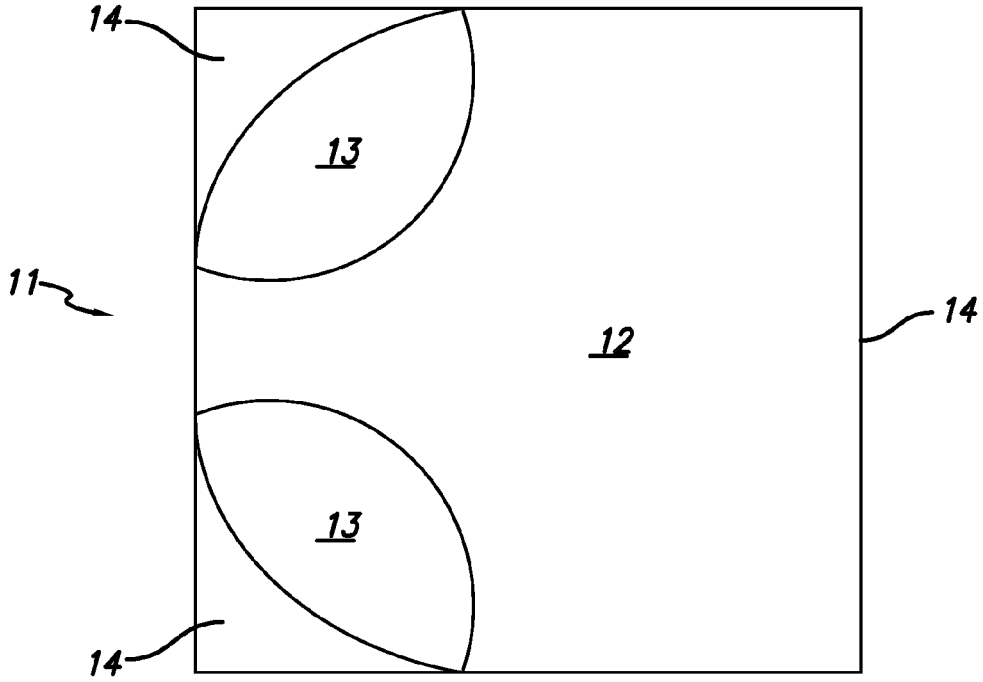
FIG. 9 is a top view of a food plate (11) comprising a first surface (12) having a slope comprising two depressions (13). The edge of the food plate forms a first rim (14), which is shown optionally curved adjacent to the depressions at the bottom of the slope.

A food plate as described above can comprise a first surface, a second surface, or a first surface and a second surface having a slope comprising two (or more) depressions. FIG. 9 is a top view of a food plate (11) comprising a first surface (12) having a slope comprising two depressions (13). The edge of the food plate forms a first rim (14), which is shown optionally curved adjacent to the depressions at the bottom of the slope. The second surface of the food plate can be flat or substantially flat. Alternatively, the second surface of the food plate can have a slope comprising one or two (or more) depressions. If the first surface has a slope comprising two (or more) depressions and the second surface has a slope comprising one or two (or more) depressions, preferably, the depressions on the first surface are on the opposite end of the plate from the depression(s) on the second surface.

The food plates can be stackable. Preferably, stackable food plates form stable stacks and do not easily topple over.

The food plate can further comprise a removable lid. The lid can be used to microwave food on the food plate and to store food on the food plate, such as in a refrigerator, a freezer, or a lunch container, and the like. When one side of the food plate has been used and the other side of the food plates is going to be used next, a removable lid can be placed on the previously used side prior to turning the plate over. The removable lid then helps to keep leftover food and/or liquid on the previously used side from making a mess on a flat surface, for example, on which the food plate is placed.

Optionally, one or more eating utensils, such as a fork, a knife, a spoon, a spork, a napkin, and/or an individually wrapped wet wipe, can be removably attached to the removable lid. The eating utensils can be colored, numbered, and/or decorated in a way to distinguish utensils belonging with one food plate (or the user of the food plate) from utensils belonging with another food plate.

Preferably, the food plate is resistant to breaking. More preferably, the food plate is unbreakable under normal use. Also preferably, the food plate is dishwasher and/or microwave safe.

The food plate can be made from any suitable material as is known in the art in accordance with methods known in the art. Preferably, the food plate is plastic. Preferred materials include polycarbonate and polypropylene, such as FDA-approved polypropylene. Preferably, the material is BPA-free, phthalate-free, and PVC-free. The food plate can vary in size and/or shape. Typically, a food plate is flat and round with a diameter from about 8 inches to about 9½ inches. The food plate can be colored, numbered, and/or decorated in a way to distinguish one food plate from another food plate (e.g., pink for girl, blue for boy).

In view of the foregoing, also provided is a method of making a food plate. The method comprises forming a food plate comprising a first surface, a second surface, and an edge. At least the first surface has a slope, which optionally comprises at least one depression, and preferably comprises one depression, at the bottom of the slope and adjacent to the edge. In this regard, while the eating surface of the plate is preferably made from a rigid material, such as a rigid plastic material, the edge of the plate, such as an edge of the plate that forms a rim can be made from a flexible plastic. At least each portion of the edge that is adjacent to the bottom of the slope on the first surface is formed into a first rim or substantially all or all of the edge is formed into a first rim and at least each portion of the first rim that is adjacent to the bottom of the slope on the first surface is pronounced or more pronounced than a portion of the first rim that is not adjacent to the bottom of the slope. The second surface also can have a slope, which optionally comprises at least one depression, and preferably comprises one depression, at the bottom of the slope and adjacent to the edge. At least each portion of the edge that is adjacent to the bottom of the slope on the second surface is formed into a second rim or substantially all or all of the edge is formed into a second rim and at least each portion of the second rim that is adjacent to the bottom of the slope on the second surface is pronounced or more pronounced than a portion of the second rim that is not adjacent to the bottom of the slope.

An adapter for a conventional food plate is also provided. The adapter comprises a graduated (i.e., difference in height from one side of the adapter to the other), optionally flexible, rim, which, upon attachment to the food plate, causes the food-bearing side of the food plate to have a slope. Desirably, the degree of the slope is sufficient to allow a liquid to move down the slope. Preferably, the degree of the slope is sufficient to allow a viscous liquid, such as syrup, to move down the slope. The degree of the slope should not be so great as to make eating off the food plate difficult. Preferably, the slope is less than about 15°, such as about 2.5°, about 5°, about 7.5°, about 10°, or about 12.5°. The graduated rim optionally comprises, and preferably does comprise, an interior groove or interior ledge, which can be continuous or intermittent, into/onto which the edge of the conventional food plate can be placed. Preferably, the graduated rim is flexible. The adapter can further comprise an adjoining depression, which, upon attachment of the adapter to the food plate, results in the depression being positioned at the bottom of the slope. The adjoining depression is optionally removable from the graduated rim or the conventional food plate at the bottom of the slope.

Figure 5:
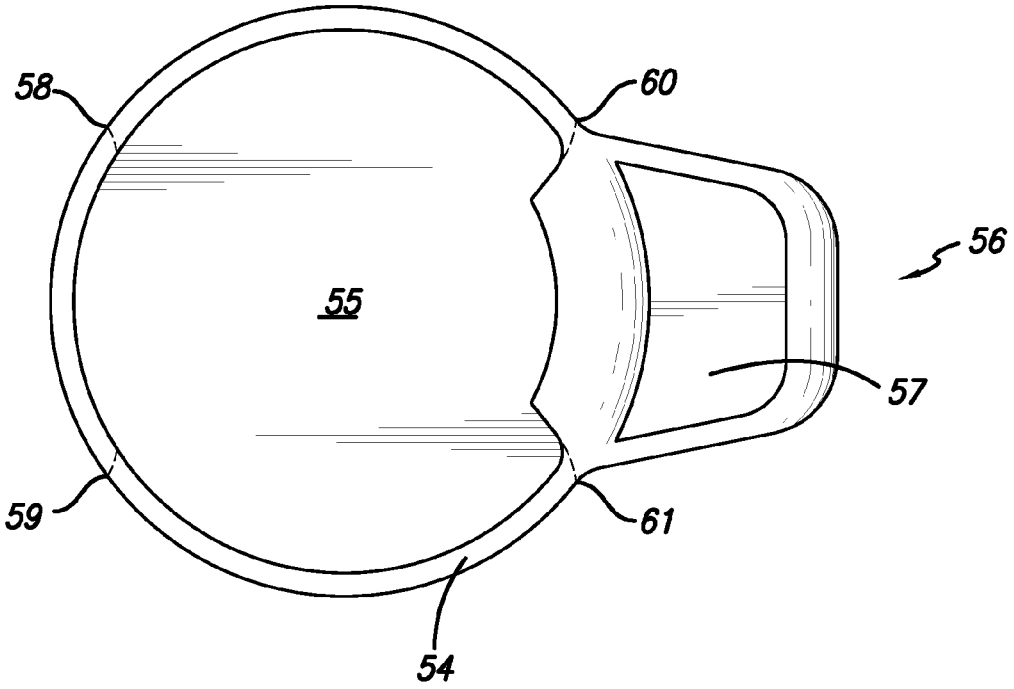
FIG. 5 is a top view of a conventional food plate (55) with an adapter (56) attached. The adapter in this figure comprises a graduated, optionally flexible, rim (54) and an optionally present adjoining depression (57). The dotted lines 58-61 show an alternate embodiment of the adapter, in which the region between dotted lines 58 and 59 represents a first part of the graduated rim (54), and the region between dotted lines 60 and 61 represents a second part of the graduated rim (54). In this alternate embodiment of the adapter the edge of the conventional food plate between dotted lines 58 and 60 and dotted lines 59 and 61, respectively, is exposed.
Figure 6:
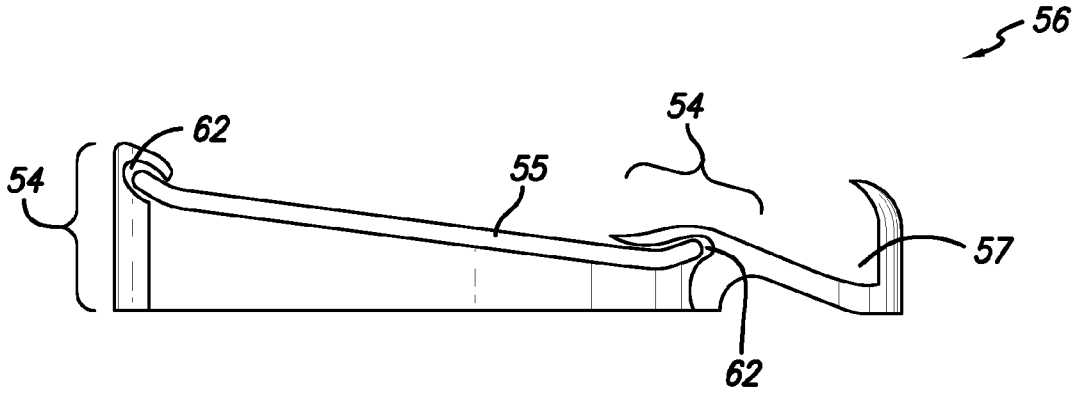
FIG. 6 is a cross-sectional view of the conventional food plate (55) with an adapter (56) having an optionally present adjoining depression (57) attached as shown in FIG. 5. In this cross-section, an interior groove (62), which is optionally present in the graduated rim (54) of the adapter (56), is shown.

An example of an adapter with an adjoining depression is shown in FIGS. 5 and 6. FIG. 5 is a top view and FIG. 6 is a cross-sectional view of a conventional food plate (55) with an adapter (56) attached. The adapter in these figures comprises a graduated rim (54) and an optionally present adjoining depression (57), which can be optionally removable. In other words, the adjoining depression (57) can be part of the graduated rim (54) or separate. If separate, preferably it is adapted for removable attachment to the graduated rim (54) or the conventional food plate at the bottom of the slope created by the adapter. The dotted lines 58-61 show an alternate embodiment of the adapter, in which the region between dotted lines 58 and 59 represents a first part, and the region between dotted lines 60 and 61 represents a second part. In this alternate embodiment of the adapter the edge of the conventional food plate between dotted lines 58 and 60 and dotted lines 59 and 61, respectively, is exposed. The cross-sectional view in FIG. 6 shows an interior groove (62; which alternatively can be an interior ledge), which is optionally present in the adapter. In other words, it can be possible to use an adapter comprising a graduated rim that does not comprise an interior groove or an interior ledge. However, preferably, the adapter comprises a graduated rim comprising an interior groove (into which the edge of the conventional plate can be placed) or an interior ledge (onto which the edge of the conventional plate can be placed). An interior groove or interior ledge, which can be continuous or intermittent, can help to stabilize the plate during use. Preferably, the graduated rim is flexible.

Figure 7:
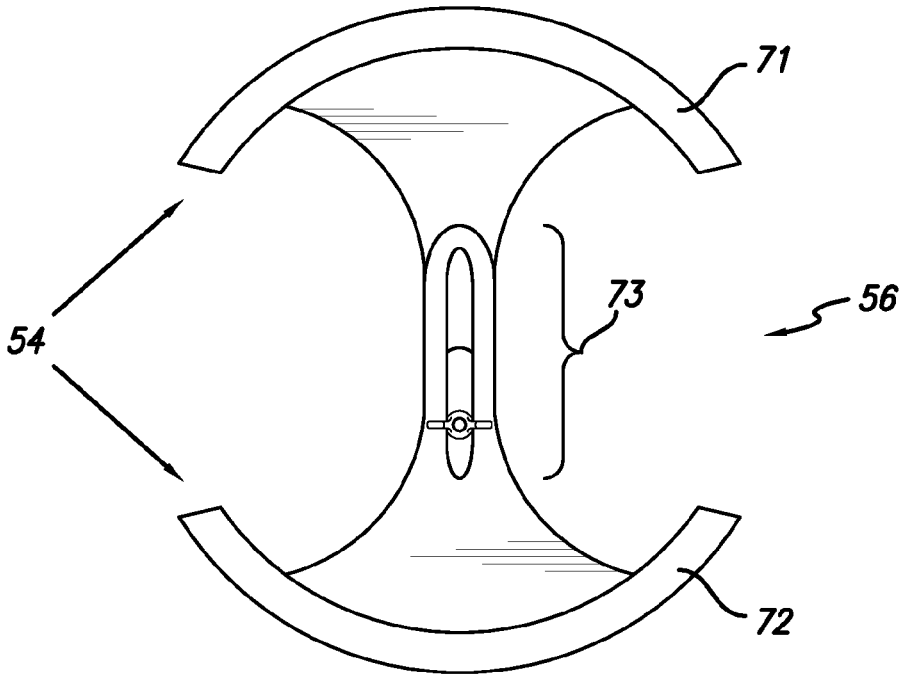
FIG. 7 is a top view of an alternate embodiment of an adapter (56). The flexible rim (54) comprises a first part (71) and a second part (72). In this top view, the adapter comprises an example of an adjuster (73), which adjusts the distance between the first part (71) and the second part (72).
Figure 8:
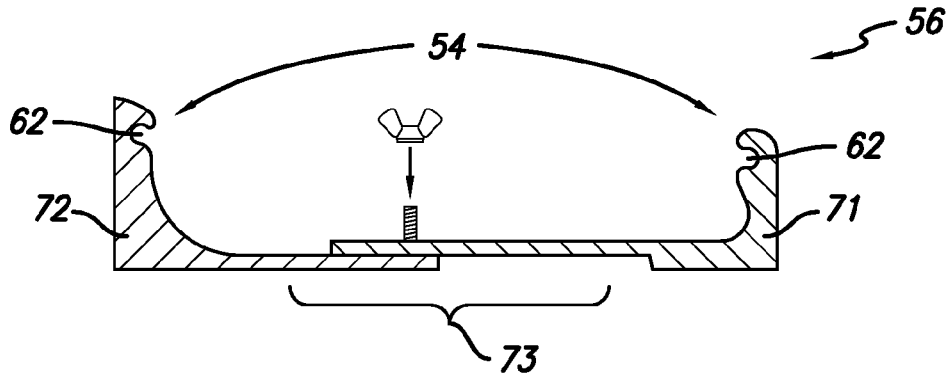
FIG. 8 is a cross-sectional view of the adapter (56) shown in FIG. 7.
Figure 10:
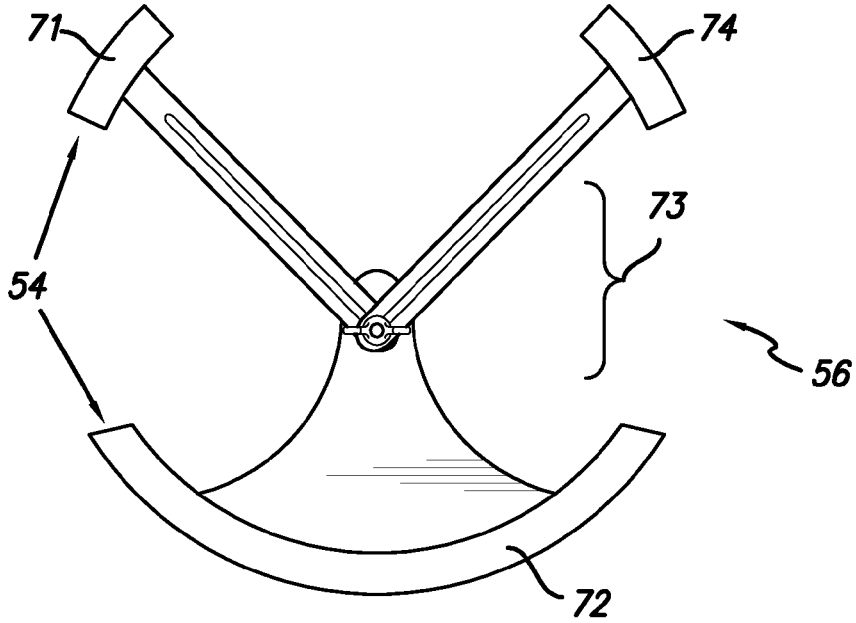
FIG. 10 is a top view of an alternate embodiment of an adapter (56). The flexible rim (54) comprises a first part (71), a second part (72), and a third part (74). In this top view, the adapter comprises an example of an adjuster (73), which adjusts the distance between the first part (71), the second part (72), and the third part (74).
Figure 11:
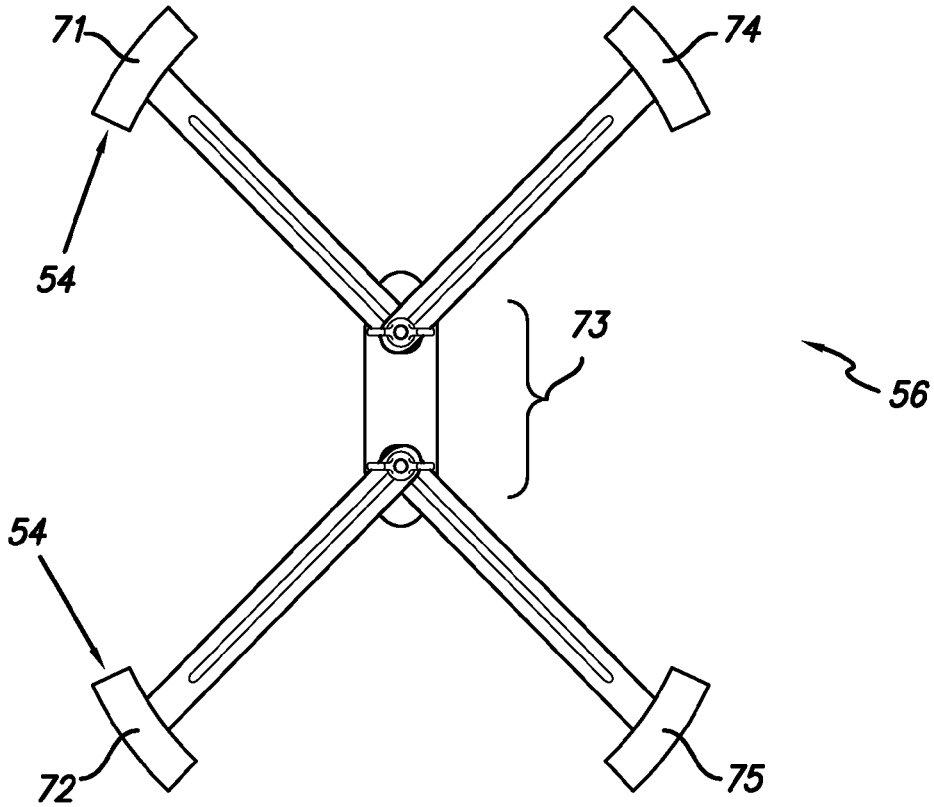
FIG. 11 is a top view of an alternate embodiment of an adapter (56). The flexible rim (54) comprises a first part (71), a second part (72), a third part (74), and a fourth part (75). In this top view, the adapter comprises an example of an adjuster (73), which adjusts the distance between the first part (71), the second part (72), the third part (74), and the fourth part (75).

In an alternate embodiment of an adapter, the graduated rim can comprise at least a first part and a second part (such as a first part, a second part, a third part, and a fourth part). An example of an alternate embodiment of an adapter is shown in FIGS. 7 and 8. FIG. 7 is a top view and FIG. 8 is a cross-sectional view of an alternate embodiment of an adapter (56). In these figures, the graduated rim (54) comprises a first part (71) and a second part (72). When the adapter comprises at least a first part and a second part, the rim need not be flexible; however, flexibility can aid positioning of the adapter onto a food plate, such as a conventional food plate. In the top view shown in FIG. 7, the adapter comprises an example of an adjuster (73), which adjusts the distance between the first part (71) and the second part (72). Adjusting the distance between the first part (71) and the second part (72) (or the distances between the first part, the second part, the third part and the fourth part) positions the adapter onto the food plate. Another example of an alternate embodiment of an adapter is shown in FIG. 10, which is a top view of an alternate embodiment of an adapter (56). The flexible rim (54) comprises a first part (71), a second part (72), and a third part (74). In this top view, the adapter comprises an example of an adjuster (73), which adjusts the distance between the first part (71), the second part (72), and the third part (74). Yet another example of an alternate embodiment of an adapter is shown in FIG. 11, which is a top view of an alternate embodiment of an adapter (56). The flexible rim (54) comprises a first part (71), a second part (72), a third part (74), and a fourth part (75). In this top view, the adapter comprises an example of an adjuster (73), which adjusts the distance between the first part (71), the second part (72), the third part (74), and the fourth part (75). While not shown in FIGS. 7, 8, 10 and 11, the parts, such as the first part (71) and the second part (72), the first part (71), the second part (72) and the third part (74), or the first part (71), the second part (72), the third part (74) and the fourth part (75), as the case may be, can comprise height adjusters, which can be used to adjust the slope of the food plate. In this regard, if an adjuster comprises two parts, the first part (71) or the second part (72) can comprise a height adjuster. If an adjuster comprises three parts, either (i) the first part (71) and the third part (74) or (ii) the second part (72), for example, can comprise a height adjuster. If an adjuster comprises four parts, either (i) the first part (71) and the third part (74) or (ii) the second part (72) and the fourth part (75), for example, can comprise a height adjuster.

Figure 12:
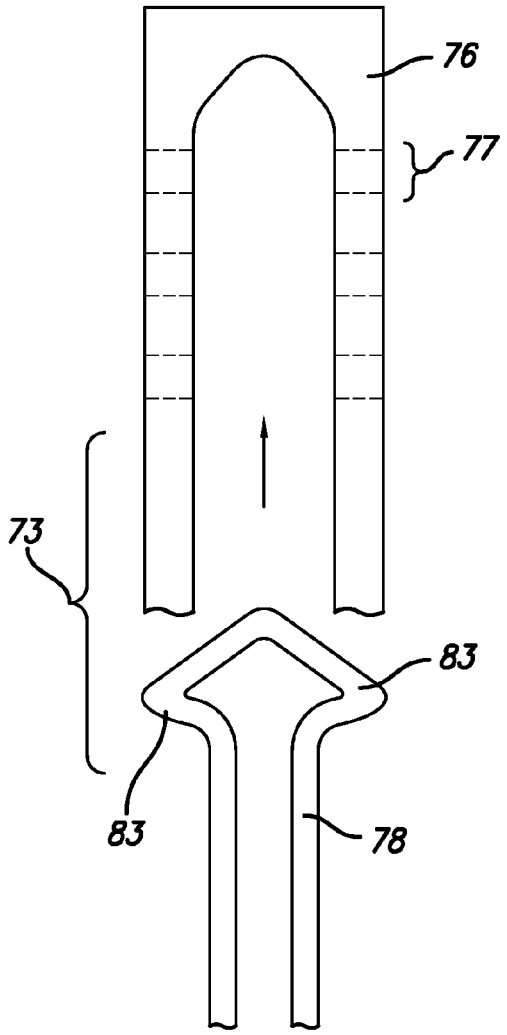
FIG. 12. is an exploded partial top view of an alternate embodiment of an adjuster (73). In this embodiment, a first part (78), which can be squeezed and released, is inserted into a second part (76), which comprises internal transverse channels (77) into which the side projections (83) on the first part (78) can be placed.
Figure 13:
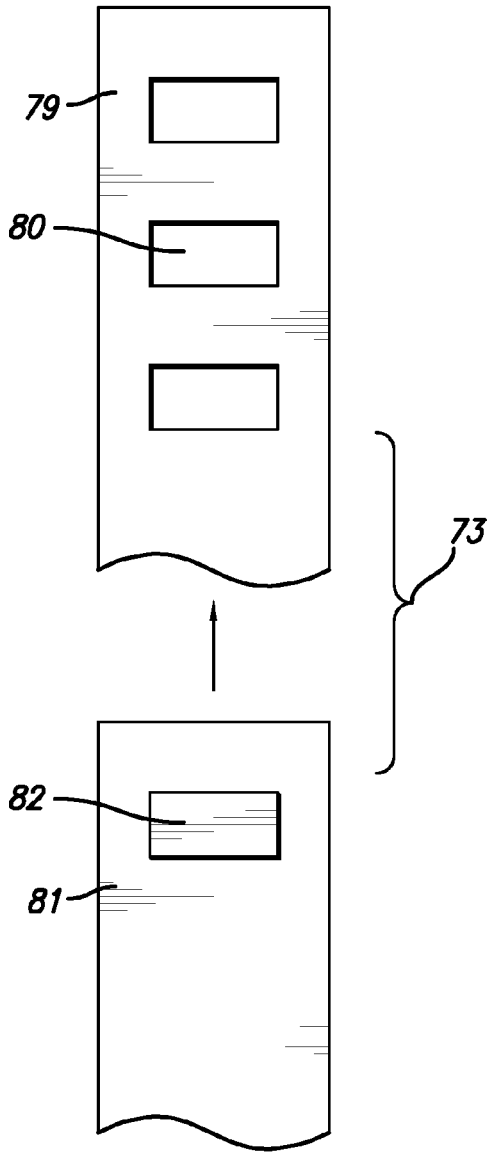
FIG. 13 is an exploded partial top view of an alternate embodiment of an adjuster (73). In this embodiment, a first part (81) comprises a top projection (82), which is inserted into an opening (80) on a second part (79).

Any suitable type of adjusters can be used. See, e.g., the adjuster (73) in FIGS. 7, 8, 10, and 11. Other examples of adjusters, which are not intended to be limiting, are shown in FIGS. 12 and 13. FIG. 12. is an exploded partial top view of an alternate embodiment of an adjuster (73). In this embodiment, a first part (78), which can be squeezed and released, is inserted into a second part (76), which comprises internal transverse channels (77) into which the side projections (83) on the first part (78) can be placed. FIG. 13 is an exploded partial top view of an alternate embodiment of an adjuster (73). In this embodiment, a first part (81) comprises a top projection (82), which is inserted into an opening (80) on a second part (79). Preferably, the adjusters can be easily adjusted, irrespective of whether the plate is already positioned between the parts or not.

The adapter can further comprise a removable lid. Optionally, eating utensils, such as those described above, can be removably attached to the lid.

In view of the foregoing, a method of making an adapter for a conventional food plate is provided. The method comprises forming a graduated, optionally flexible, rim, which optionally comprises at least a first part and a second part and which, upon attachment to the conventional food plate, causes the food-bearing side of the food plate to have a slope, and, optionally, introducing an interior groove or interior ledge into the graduated rim into/onto which the edge of the conventional food plate can be placed. Preferably, the method comprises introducing the interior groove or interior ledge, which can be continuous or intermittent, into the graduated rim. The graduated rim can further comprise an adjoining depression, which, upon attachment of the adapter to the conventional food plate, results in the depression being positioned at the bottom of the slope. If the graduated rim further comprises an adjoining depression, the adjoining depression can be part of the graduated rim or adapted for removable attachment to the graduated rim or the food plate at the bottom of the slope. The method can further comprise introducing an adjuster between at least the first part and the second part.

All patents, patent application publications, journal articles, textbooks, and other publications mentioned in the specification are indicative of the level of skill of those in the art to which the disclosure pertains. All such publications are incorporated herein by reference to the same extent as if each individual publication were specifically and individually indicated to be incorporated by reference.

The invention illustratively described herein may be suitably practiced in the absence of any element(s) or limitation (s), which is/are not specifically disclosed herein. Thus, for example, each instance herein of any of the terms "comprising," "consisting essentially of," and "consisting of" may be replaced with either of the other two terms. Likewise, the singular forms "a," "an," and "the" include plural references unless the context clearly dictates otherwise. Thus, for example, references to "the method" includes one or more methods and/or steps of the type, which are described herein and/or which will become apparent to those ordinarily skilled in the art upon reading the disclosure.

The terms and expressions, which have been employed, are used as terms of description and not of limitation. There also is no intention in the use of such terms and expressions of excluding any equivalents of the features shown and described or portions thereof.

It is recognized that various modifications are possible within the scope of the claimed invention. Thus, it should be understood that, although the present invention has been specifically disclosed in the context of preferred embodiments and optional features, those skilled in the art may resort to modifications and variations of the concepts disclosed herein. Such modifications and variations are considered to be within the scope of the invention as defined by the appended claims.

What is claimed is:

1. A reversible food plate comprising:

a first surface and a second surface, each of which has a slope, and an edge, wherein the slope of the first surface optionally comprises at least one depression at the bottom of the slope and adjacent to the edge, and wherein (i) at least each portion of the edge that is adjacent to the bottom of the slope forms a first rim or (ii) substantially all or all of the edge forms a first rim and at least each portion of the first rim that is adjacent to the bottom of the slope is pronounced or more pronounced than a portion of the first rim that is not adjacent to the bottom of the slope, wherein the slope of the second surface optionally comprises at least one depression at the bottom of the slope and adjacent to the edge, and wherein (i) at least each portion of the edge that is adjacent to the bottom of the slope forms a second rim or (ii) substantially all or all of the edge forms a second rim and at least each portion of the second rim that is adjacent to the bottom of the slope is pronounced or more pronounced than a portion of the second rim that is not adjacent to the bottom of the slope, wherein the bottom of the slope of the first surface is on the opposite end of the plate from the bottom of the slope of the second surface, wherein, except for the bottom of the slope of the first surface being on the opposite end of the plate from the bottom of the slope of the second surface, the first surface of the plate, together with the first rim, is identical to the second surface of the plate, together with the second rim, and wherein, when food is being eaten from the second surface, the first rim of the first surface can be stably placed on a flat or substantially flat surface with the outer edge or edges of the first rim substantially parallel or parallel to the flat or substantially flat surface, and, when food is being eaten from the first surface, the second rim of the second surface can be stably placed on a flat or substantially flat surface with the outer edge or edges of the second rim substantially parallel or parallel to the flat or substantially flat surface.

2. The reversible food plate of claim 1, wherein the slope of the first surface comprises one depression.

3. The reversible food plate of claim 1, which is stackable.

4. The reversible food plate of claim 1, which further comprises at least one removable lid to which is optionally removably attached one or more eating utensils.

5. The reversible food plate of claim 1, wherein the slope of the second surface comprises one depression.

6. A method of using a reversible food plate comprising a first surface and a second surface, each of which has a slope, and an edge, wherein the slope of the first surface optionally comprises at least one depression at the bottom of the slope and adjacent to the edge, and wherein (i) at least each portion of the edge that is adjacent to the bottom of the slope forms a first rim or (ii) substantially all or all of the edge forms a first rim and at least each portion of the first rim that is adjacent to the bottom of the slope is pronounced or more pronounced than a portion of the first rim that is not adjacent to the bottom of the slope, and the first rim of the first surface can be stably placed on a flat or substantially flat surface with the outer edge or edges of the first rim substantially parallel or parallel to the flat or substantially flat surface, wherein the slope of the second surface optionally comprises at least one depression at the bottom of the slope and adjacent to the edge, and wherein (i) at least each portion of the edge that is adjacent to the bottom of the slope forms a second rim or (ii) substantially all or all of the edge forms a second rim and at least each portion of the second rim that is adjacent to the bottom of the slope is pronounced or more pronounced than a portion of the second rim that is not adjacent to the bottom of the slope, and the second rim of the second surface can be stably placed on a flat or substantially flat surface with the outer edge or edges of the second rim substantially parallel or parallel to the flat or substantially flat surface, and wherein the bottom of the slope of the first surface is on the opposite end of the plate from the bottom of the slope of the second surface, which method comprises:

eating food from the first surface of the plate, and turning the plate over and eating food from the second surface of the plate, whereupon the reversible food plate is used.

7. The method of claim 6, wherein the first rim and the second rim of the plate form a side wall having an external surface and, when the first rim of the first surface or the second rim of the second surface is placed on a flat or substantially flat surface, the external surface of the side wall is perpendicular to the flat or substantially flat surface.

8. The method of claim 6, wherein, except for the bottom of the slope of the first surface being on the opposite end of the plate from the bottom of the slope of the second surface, the first surface of the plate, together with the first rim, appears is identical to the second surface of the plate, together with the second rim.

9. A method of using a stackable, reversible food plate comprising a first surface having a slope, a second surface having a slope, an edge, and at least one lid, wherein the at least one lid is (i) a lid on the first surface, (ii) a lid on the second surface, or (iii) a lid on the first surface and a lid on the second surface, wherein the slope of the first surface optionally comprises at least one depression at the bottom of the slope and adjacent to the edge, and wherein (i) at least each portion of the edge that is adjacent to the bottom of the slope forms a first rim or (ii) substantially all or all of the edge forms a first rim and at least each portion of the first rim that is adjacent to the bottom of the slope is pronounced or more pronounced than a portion of the first rim that is not adjacent to the bottom of the slope, wherein the slope of the second surface optionally comprises at least one depression at the bottom of the slope and adjacent to the edge, and wherein (i) at least each portion of the edge that is adjacent to the bottom of the slope forms a second rim or (ii) substantially all or all of the edge forms a second rim and at least each portion of the second rim that is adjacent to the bottom of the slope is pronounced or more pronounced than a portion of the second rim that is not adjacent to the bottom of the slope, and wherein the bottom of the slope of the first surface is on the opposite end of the plate from the bottom of the slope of the second surface, which method comprises:

eating food from the first surface of the plate, then placing a lid on the first surface of the plate and turning the plate over, and eating food from the second surface of the plate, whereupon the stackable, reversible food plate is used.

10. The method of claim 9, which further comprises removing a lid from the first surface of the plate prior to eating food from the first surface.

11. The method of claim 9, which further comprises removing a lid from the second surface of the plate or to eating food from the second surface.

12. The method of claim 9, which further comprises placing a lid on the second surface of the plate after eating food from the second surface of the plate.

13. A method of using a reversible food plate comprising a first surface, a second surface, and an edge, wherein the first surface has a slope, wherein the slope of the first surface optionally comprises at least one depression at the bottom of the slope and adjacent to the edge, wherein (i) at least each portion of the edge that is adjacent to the bottom of the slope forms a first rim or (ii) substantially all or all of the edge forms a first rim and at least each portion of the first rim that is adjacent to the bottom of the slope is pronounced or more pronounced than a portion of the first rim that is not adjacent to the bottom of the slope, and the first rim of the first surface can be stably placed on a flat or substantially flat surface with the outer edge or edges of the first rim substantially parallel or parallel to the flat or substantially flat surface, and wherein the second surface is substantially flat or flat and optionally slip-resistant, which method comprises in either order:

eating food from the first surface of the plate, and turning the plate over and eating food from the second surface of the plate, whereupon the reversible food plate is used.

* * * * *

UNITED STATES PATENT AND TRADEMARK OFFICE

CERTIFICATE OF CORRECTION

PATENT NO. : 8,844,752 B2
APPLICATION NO. : 13/918982
DATED : September 30, 2014
INVENTOR(S) : Sirota et al.

It is certified that error appears in the above-identified patent and that said Letters Patent is hereby corrected as shown below:

In the Claims,

Claim 8, Column 12, line 1 should read as follows:
--first surface of the plate, together with the first rim, is--

Claim 11, column 12, line 42 should read as follows:
--removing a lid from the second surface of the plate prior to eating--

Signed and Sealed this
Twenty-fourth Day of February, 2015

Michelle K. Lee

Michelle K. Lee
*Deputy Director of the United States Patent and Trademark Office*